United States Patent [19]

Allen

[11] 4,314,773

[45] Feb. 9, 1982

[54] HIGH DENSITY CONCRETE PLACER

[75] Inventor: J. Dewayne Allen, Paragould, Ariz.

[73] Assignee: Allen Engineering Corporation, Paragould, Ark.

[21] Appl. No.: 105,938

[22] Filed: Dec. 21, 1979

[51] Int. Cl.[3] ..... E01C 19/38

[52] U.S. Cl. ..... 404/116; 404/119; 425/219

[58] Field of Search ..... 404/116, 119, 118, 101, 404/102, 108; 425/219

[56] References Cited

U.S. PATENT DOCUMENTS

| | | | |
|---|---|---|---|
| 2,248,103 | 7/1941 | Mall | 404/116 |
| 2,261,659 | 11/1941 | Pierce | 404/116 |
| 2,380,435 | 7/1945 | Heltzel | 404/102 |
| 2,583,108 | 1/1952 | Lewis | 404/101 |
| 3,110,234 | 11/1963 | Oster | 404/119 |
| 3,377,933 | 4/1968 | Dale | 404/119 |
| 3,593,627 | 7/1971 | Rowe | 404/119 |
| 3,738,763 | 6/1973 | Glesmann | 404/119 |
| 3,753,621 | 8/1973 | Dale | 404/116 |
| 4,128,359 | 12/1978 | Cooper | 404/116 X |
| 4,249,327 | 2/1981 | Allen | 404/119 X |

*Primary Examiner*—Nile C. Byers, Jr.
*Attorney, Agent, or Firm*—Cahill, Sutton & Thomas

[57] ABSTRACT

A high density concrete placer is longitudinally translatable along a pair of parallel oriented support rails positioned adjacent to an area in which wet concrete has been poured. The concrete placer includes a bridge having first and second ends and first and second roller assemblies coupled to the first and second ends of the bridge. The roller assemblies contact the support rails and enable the bridge to be longitudinally translated along the support rails. A frame includes a plurality of immersible vibrator units which are coupled at spaced apart intervals along one side of the frame and descend vertically downward therefrom. A rolling table is coupled to the bridge and to the frame to be laterally translated between the first and second ends of the bridge. The frame includes a subframe which is vertically displaceable between a first and a second position and serves to vertically displace the vibrator units between a first and a second position. In the first position the vibrator units are positioned above the surface of the wet concrete and in the second position the vibrator units are immersed in the wet concrete.

53 Claims, 9 Drawing Figures

HIGH DENSITY CONCRETE PLACER

BACKGROUND OF THE INVENTION

1. Field of the Invention

The present invention relates to equipment for compacting and densifying wet concrete, and more particularly, to mechanical internal vibration devices which include immersible vibrator units positionable below the surface of a mass of wet concrete.

2. Description of the Prior Art

The prior art includes a wide variety of mechanical internal vibration devices for settling and densifying wet concrete. U.S. Pat. No. 4,128,359 (Cooper) discloses a self-propelled concrete vibrator apparatus which includes a plurality of hydraulically powered vibrators positioned at evenly spaced apart intervals across the full width of a support truss. This device includes a plurality of hydraulic rams which raise and lower the plurality of vibrator units into and out of a mass of wet concrete. A second group of horizontally oriented hydraulic rams is coupled to the plurality of vibrator units and laterally displaces the vibrator units between a first and a second position. This device includes an hydraulic pump driven by an internal combustion engine and a plurality of four drive units for longitudinally translating the entire structure along the length of the concrete to be vibrated.

U.S. Pat. No. 2,223,734 (Mall) discloses a concrete vibrator which is longitudinally translatable along the length of an area of wet concrete. This device includes a vibrator carriage to which an engine is mounted. This vibrating carriage is longitudinally translatable between a first and a second position and includes a centrally mounted shaft which permits the carriage to be pivoted and to thereby partially elevate the mechanically driven concrete vibrators with respect to the surface of the wet concrete. U.S. Pat. No. 2,248,103 (Mall) discloses an attachment for a screed which includes a laterally oriented frame having a plurality of evenly spaced apart vibrators. A hand actuated lever permits an operator to simultaneously raise or lower all of the vibrators with respect to the surface of the wet concrete. U.S. Pat. No. 1,945,145 (Gordon) discloses an apparatus for compacting and dewatering wet cemet. The body of this device includes a hand operated lever which permits the entire device, including a plurality of vertically oriented fixed position vibrators and the vacuum chamber of the invention, to be raised or lowered with respect to the surface of the concrete. In the raised position, the entire device can be longitudinally translated with respect to the wet concrete.

U.S. Pat. No. 2,138,103 (Jorgensen) discloses a road paving machine which includes four motor driven vibrators which are mounted in laterally fixed positions to a longitudinally translatable carriage. A strike off bar is coupled to the carriage at a position behind the vibrator unit. A hand wheel in combination with a worm gear permits the vibrator assembly to be raised or lowered with respect to the surface of the concrete. When the vibrators are lowered into the surface of the concrete and the machine is advanced, the vibrators are deflected to the rear and are dragged through the surface of the wet concrete.

U.S. Pat. No. 2,382,096 (Pierce) discloses a paving machine having a plurality of vibrator units mounted at fixed positions laterally across the face of the device. The vibrators span the entire width of the wet concrete surface to be vibrated. This device includes a concrete screed and is hydraulically powered. The plurality of vibrators are pivoted about a point and inserted at an angle into the wet concrete in a manner which permits the vibrators to travel beneath the concrete screed.

U.S. Pat. No. 2,292,733 (Bily) discloses a concrete vibrating device including a plurality of vibrators mounted at a fixed position along the entire width of the device. The vibrators are flexibly coupled to the frame which permits them to be deflected to the rear of the frame as it advances through the concrete. U.S. Pat. No. 2,461,500 (Miller) discloses an apparatus for compacting concrete slabs which includes a plurality of vibrator units mounted at fixed positions laterally across the device. Each vibrator is driven by a motor coupled to a flexible shaft. The vibrators trail behind and penetrate below the surface of the wet concrete as the device is advanced through the concrete.

U.S. Pat. No. 3,555,983 (Swisher) discloses a paving grout control device which includes vibrator units positioned at evenly spaced intervals laterally across the front of the device. This device includes a comb-like structure which is immersed at a point behind the vibrating units at a predetermined depth into the paving material. U.S. Pat. No. 2,148,214 (Mall) discloses a vibrating machine which includes an inverted "T"-shaped horizontally oriented vibrating tube which is immersed into the wet concrete. U.S. Pat. No. 2,233,833 (Jackson) discloses a related device having three horizontally oriented vibrating tubes which vibrate the wet concrete. A screed also forms a part of this device which served to level the surface of the wet concrete. U.S. Pat. No. 3,113,494 (Barnes) discloses a machine for finishing concrete surfaces and includes a mechanically vibrated screed. This device is laterally translated by a pair of manually operated winches one of which is coupled to each end of the frame of this device.

The following U.S. Patents disclose inventions relevant to applicant's invention: No. 1,747,555 (Pelton); No. 2,030,315 (Noble); No. 1,898,158 (Winkler); and No. 3,413,902 (Malan).

Many of the devices discussed above are hydraulically powered and include hydraulically driven vibrator devices. Hydraulically powered vibrating equipment is comparatively heavy since the hydraulic power source is typically mounted to the frame of the vibrating device. The weight of this hydraulically powered vibrating equipment is further increased since the frame itself must be heavier to support the substantial weight of the hydraulic power source.

Virtually all of the devices described above incorporate a plurality of vibrator units which are mounted at uniformly spaced apart intervals across the full span of the supporting frame. If any particular prior art concrete vibrating device can be modified to vibrate different widths of concrete surfaces, the width of the support frame must be modified and a corresponding number of vibrating units must either be added to or subtracted from the device. This particular requirement not only increases the weight of the equipment which has been adapted to vibrate wide concrete surfaces, but also substantially increases the cost of a widened device since each vibrator unit is a highly specialized, high cost piece of equipment. The addition of vibrator units to a widened device also requires that the hydraulic or mechanical power unit produce an increased amount of power to drive the added vibrator units.

SUMMARY OF THE INVENTION

It is therefore a primary object of the present invention to provide a high density concrete placer which utilizes a fixed number of pneumatically powered immersible vibrator units to provide mechanical internal vibration to concrete surfaces of any width.

Another object of the present invention is to provide a high density concrete placer which includes a group of immersible vibrator units which can be both laterally and longitudinally displaced with respect to a bridge which supports the vibrator units above a mass of wet concrete.

Yet another object of the present invention is to provide a high density concrete placer which can vibrate variable width concrete surfaces with only minimal changes in the weight of entire device.

Still another object of the present invention is to provide a high density concrete placer which can be pneumatically powered by a remotely located air compressor.

Briefly stated, and in accord with one embodiment of the invention, a high density concrete placer is longitudinally tanslated along an area in which wet concrete has been poured. The placer comprises a bridge having first and second ends and means for supporting the bridge above the surface of the wet concrete. The support means also permits the bridge to be longitudinally translated over the surface of the wet concrete. A frame includes a plurality of immersible vibrator units which are coupled at spaced apart intervals along one side of the frame and which extend vertically downward therefrom. First means is coupled to the bridge and to the frame to enable the frame to be laterally translated between the first and second ends of the bridge. Second means is coupled to the frame for vertically displacing the vibrator units between a first and a second position wherein the vibrator units are positioned above the surface of the wet concrete in the first position and are immersed in the wet concrete in the second position.

The present invention may also include means coupled to the frame for longitudinally displacing the vibrator units between a first and a second longitudinal position in order to densify twice the area of concrete before it is necessary to longitudinally translate the bridge with respect to the surface of the wet concrete.

DESCRIPTION OF THE DRAWINGS

The invention is pointed out with particularity in the appended claims. However, other objects and advantages together with the operation of the invention may be better understood by reference to the following detailed description taken in connection with the following illustrations wherein:

DESCRIPTION OF THE PREFERRED EMBODIMENT

In order to better illustrate the advantages of the invention and its contributions of the art, a preferred hardware embodiment of the invention will now be described in some detail.

Figure 1:
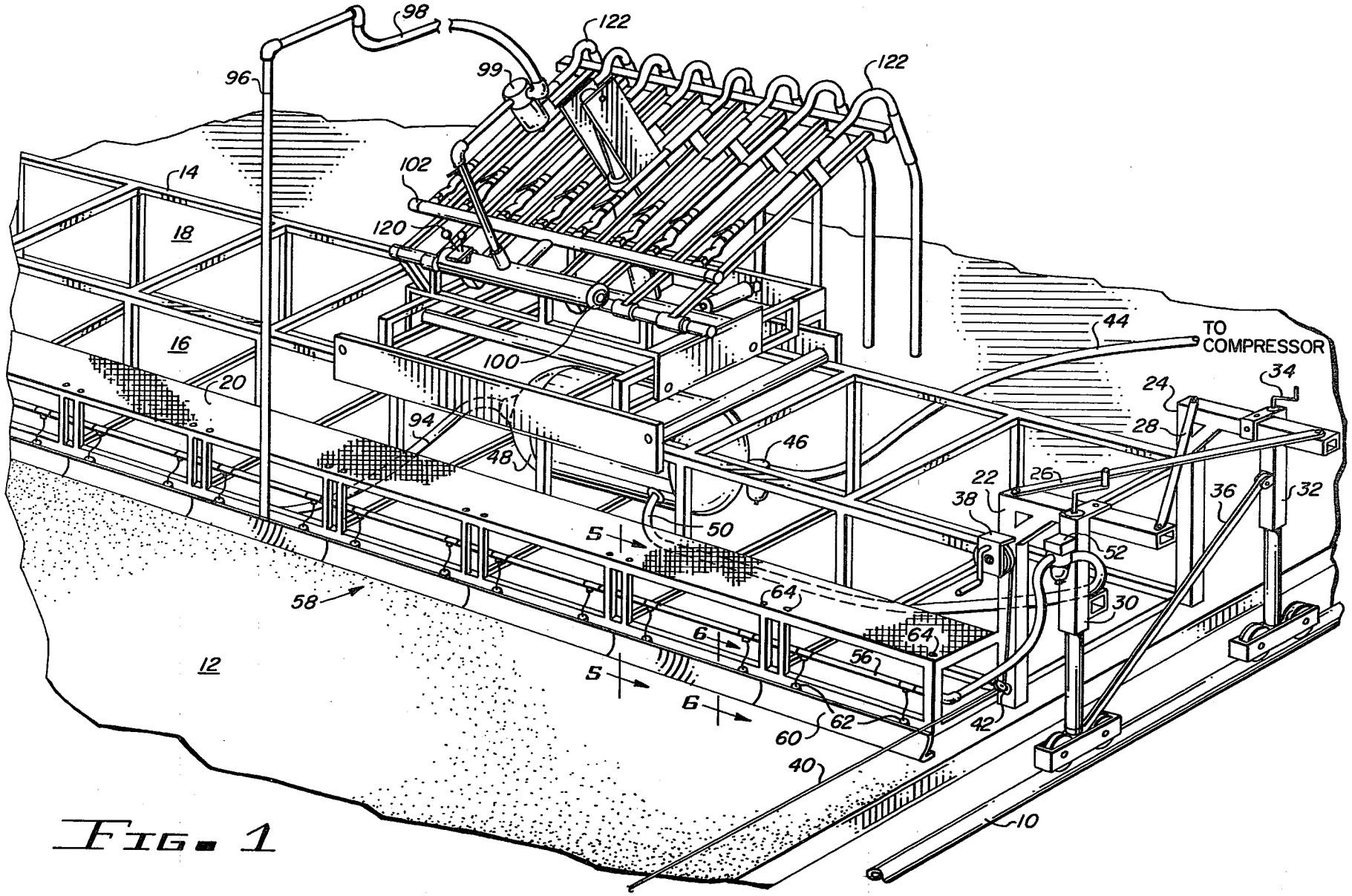
FIG. 1 is a partial perspective view of the high density concrete placer of the present invention. The structure of the left hand side of the bridge which is not illustrated in FIG. 1 is virtually a mirror image of the structure shown at the extreme right hand side of FIG. 1.

Referring now to FIG. 1, a pair of support rails, such as support rail 10, are positioned adjacent to an area 12 in which wet concrete has been poured. An open frame bridge 14 is fabricated from lengths of square steel tubing which are welded together. The specific structural configuration of bridge 14 as illustrated in FIG. 1 has been somewhat simplified for the purposes of illustration. The open frame bridge 14 of the preferred embodiment of the present invention includes diagonal support members which reinforce the open rectangular sections such as sections 16 and 18 in the front and rear sides of the main body of bridge 14. An eight inch high by twelve inch wide walkway 20 is coupled to the front of bridge 14 and spans the entire width of bridge 14.

Bridge 14 is formed from a plurality of variable width sections which are bolted together to form a single bridge which can have a width up to at least sixty feet. The bridge sections are typically fabricated in two, five and seven and one-half foot widths. A plurality of horizontally oriented bolts and nuts penetrate through horizontally oriented apertures in abutting vertically oriented elements of adjacent bridge sections together into whatever width is required for any particular project.

In the preferred embodiment of the present invention, bridge 14 is fabricated with a height of twenty-four inches and a front to rear dimension of thirty-six inches.

Heavy structural members 22 and 24 are bolted as illustrated in FIG. 1 to each end of bridge 14. Cross braces 26 and 28 are coupled as shown between the horizontally oriented sections 22 and 24 to maintain these two elements in proper alignment.

Figure 5:
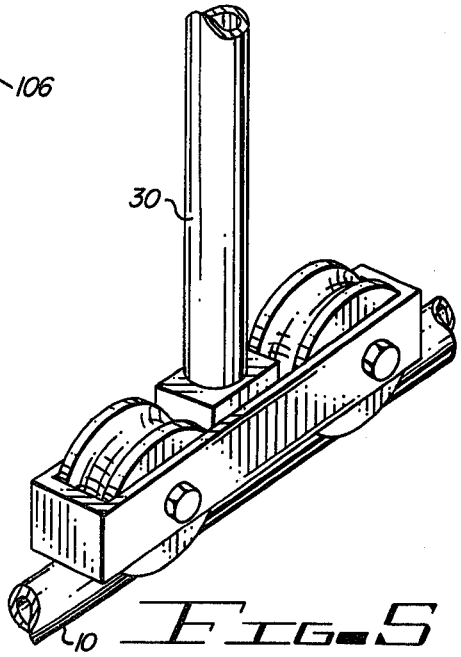
FIG. 5 is a partially cut away perspective view of one of the roller assemblies which is coupled to each end of the bridge and which enables the bridge to be translated along the support rails.

Roller assemblies 30 and 32 are clamped to end sections 22 and 24 at laterally variable positions as desired. FIG. 5 illustrates the specific configuration of roller assembly 30. Each roller assembly includes a jack screw adjustment feature which is manually controlled by jack screw handle 34 to permit bridge 14 to be maintained in a level position even though the support rails at one end of the bridge may be at a different elevation than the support rail at the opposite end of the bridge. Another cross brace 36 is coupled as shown to roller assemblies 30 and 32 to maintain these roller assemblies with an appropriate vertical orientation as the bridge is longitudinally translated into the newly poured wet concrete.

The specific structure of end sections 22 and 24 in combination with the clamps which couple roller assemblies 32 and 34 to these end sections permits bridge 14 to be skewed with respect to the two parallel-oriented support rails 10. In a skewed position, bridge 14 is oriented at an angle other than a ninty degree angle to support rails 10. A skewed configuration is frequently required when the entry and exit ends of a bridge joins the adjacent roadway at an angle. This situation frequently occurs when a roadway or railroad track passes beneath a bridge at an angle other than ninty degress.

A manually operated winch 38 is coupled to the front side of end section 22. The winch cable 40 extends downward from winch 38 and passes through and is deflected into a horizontal plane by pulley 42. The free hand of cable 40 is coupled to an immovable object positioned in front of the high density concrete placer.

A remotely located source of compressed air is coupled by a flexible air hose 44 to trap 46 which both filters and lubricates the incoming compressed air as it travels into surge tank 48. Flexible air hose 50 is coupled to an output port of surge tank 48. The opposite end of air hose 50 is coupled to air trap 52. Another air hose couples air trap 52 to air distribution manifold 56. A concrete strike off referred to generally by reference number 58 spans the entire width of bridge 14. Strike off 58 is formed from a plurality of twenty-four inch long blade sections such as blade section 60.

Figure 6:
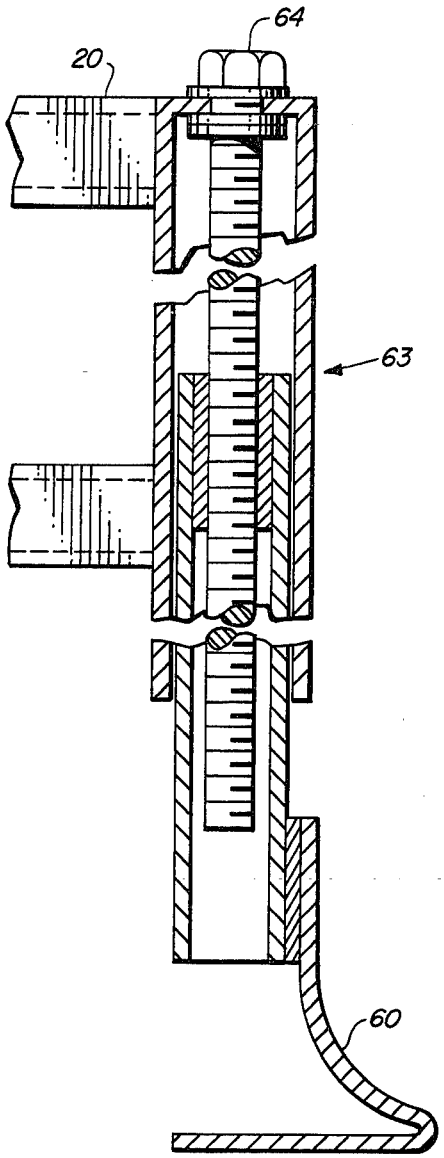
FIG. 6 is a sectional view of the jack screw which adjusts the elevation of the strike off blade.
Figure 7:
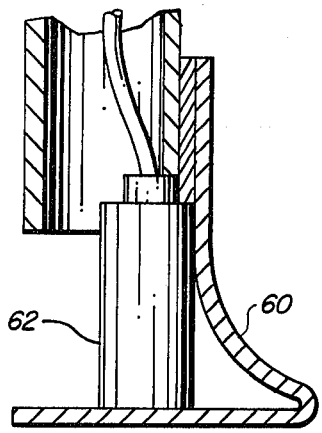
FIG. 7 is a sectional view of the strike off blade showing the positioning and coupling of the air vibrator unit.

Referring now also to FIGS. 6 and 7, blade section 60 includes a curved vertically descending blade element and a horizontally oriented blade element which is coupled to the lowermost part of the vertically descending blade section. A cylindrically shaped, commercially available air vibrator is coupled in the vincinity of each end of each blade section. A small diameter air hose couples a supply of compressed air to air distribution manifold 56 to each air vibrator 62. Air vibrator 62 operates at between seven to ten thousand vibrations per minute and is of the type commercially available from the Navco Air Vibrator Company or from Allen Engineering Company of Paragould, Ark.

Referring now to FIGS. 1 and 6, a jack screw adjusting mechanism 63 is coupled to each end of each blade section 60 to permit the elevation of each end of each blade section to be independently adjusted. Bolt head 64 extends through the forward end of the upper surface of cat walk 20 and permits a workman to readily make adjustments to the elevation of each strike off blade section 60. These adjustments permit a flat, roottop, parabolic or inverted crown to be formed on the upper surface of the concrete by concrete strike off 58.

Figure 2:
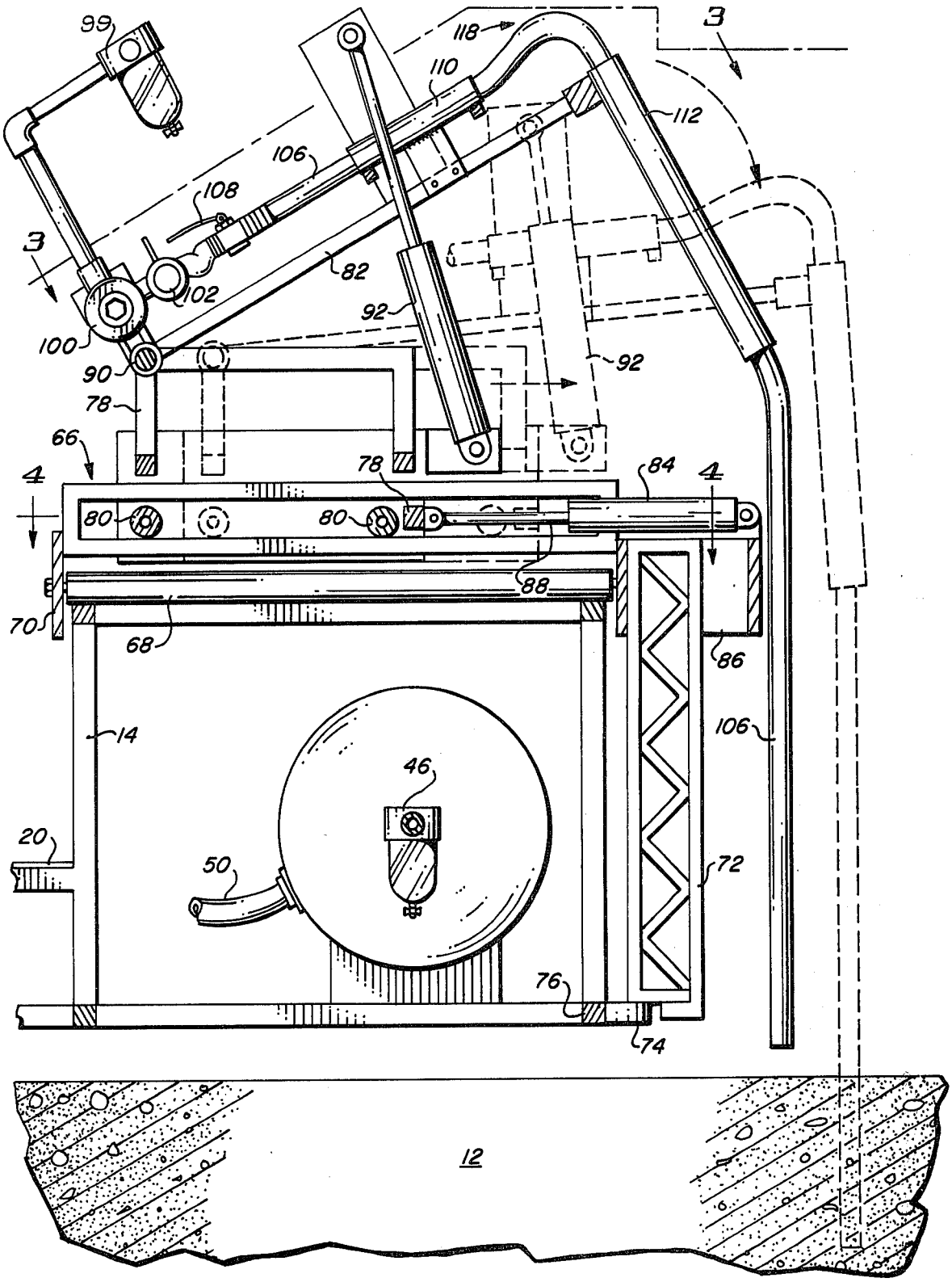
FIG. 2 is a sectional view of the high density concrete placer illustrated in FIG. 1, particularly illustrating the vertical and longitudinal displacements of the immersible vibrator units.
Figure 3:
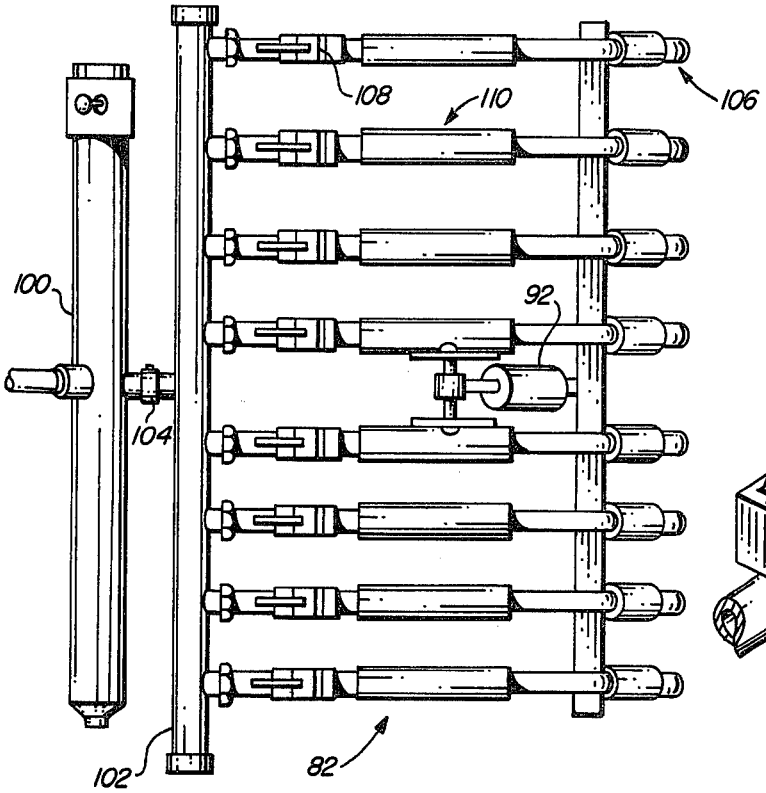
FIG. 3 is a view from above of the high density concrete placer illustrated in FIG. 2, taken along section line 3—3, particularly illustrating a part of the subframe which supports the plurality of immersible vibrator units.
Figure 4:
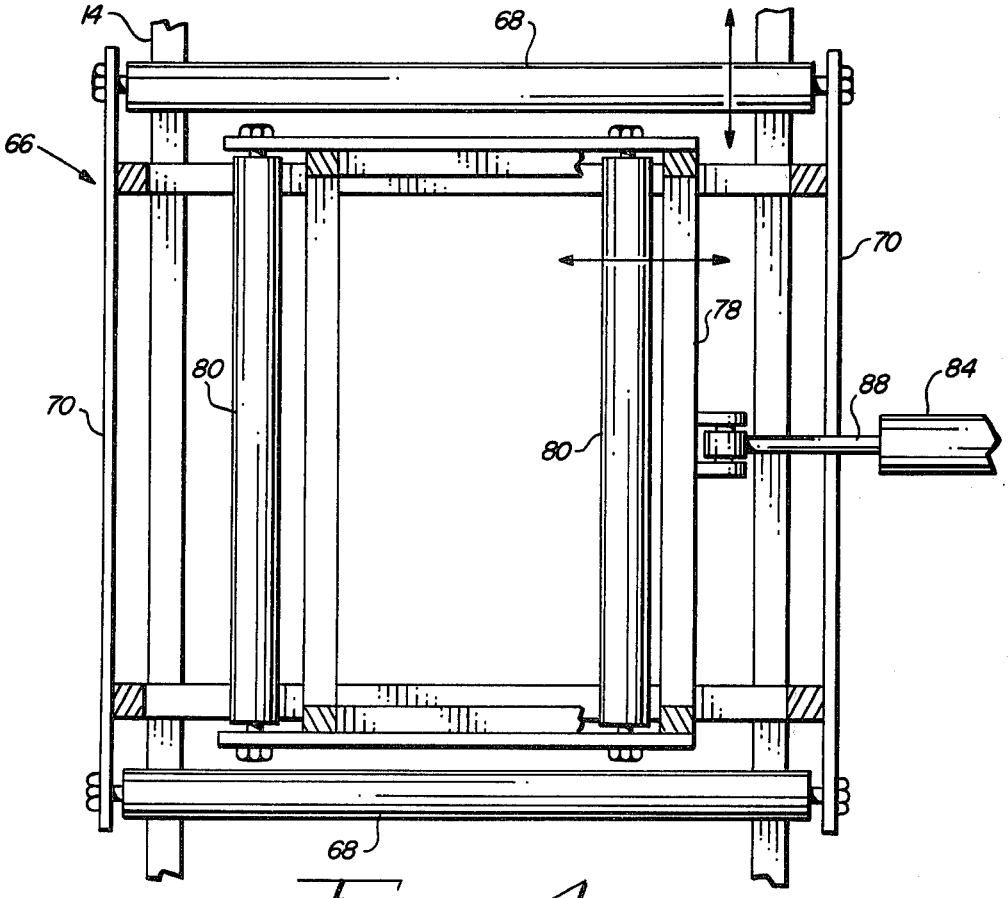
FIG. 4 is a partially cut away view from above of the high density concrete placer illustrated in FIG. 2 taken along section line 4—4, particularly illustrating the laterally and longitudinally translatable frame to which the immersible vibrator units are coupled.

Referring now to FIGS. 2, 3 and 4, the transport mechanism for the plurality of immersible air vibrators will now be described. A rolling table indicated generally by reference number 66 includes a first pair of longitudinally oriented rollers 68. Rollers 68 are coupled to guard rails 70 and the combination of these two elements permits rolling table 66 to be freely laterally displaced from the first end of bridge 14 to the second end of bridge 14. Rolling table 66 is laterally displaced manually. Rollers 68 are formed from two inch diameter steel tubing in which bearing assemblies have been inserted. Vertically oriented rolling table support brackets 72 are coupled as shown in FIGS. 2 and 4 and include a roller 74 at the lower end thereof which establish a rolling contact with the lower rear horizontally oriented bridge element 76. Support brackets 72 are included in the preferred embodiment of the invention to prevent rolling table 66 from being tilted when the air vibrator assembly is displaced.

Rolling table 66 also includes a sub-frame 78 which is movably coupled to the lower section of table 66 by a pair of rollers 80. Sub-frame 78 and rollers 80 permit the air vibrator carriage assembly 82 illustrated in FIGS. 2 and 3 and referred generally by reference number 82 to be longitudinally displaced between a first retracted position and a second extended position. The body 84 of a pneumatically powered ram is coupled to a bracket 86 which forms a part of the laterally displaceable frame of rolling table 66 as illustrated in FIG. 2. The actuator arm 88 of pneumatic ram 84 is coupled to sub-frame 78 and causes it to be displaced between the first and second positions. The forward end of air vibrator carriage assembly 82 is pivotally coupled to sub-frame 78 at the position indicated by reference number 90. A second pneumatic ram 82 includes a body coupled to sub-frame 78 and an actuator arm coupled to air vibrator carriage assembly 82 as is specifically illustrated in FIG. 2. Ram 82 displaces air vibrator carriage assembly 82 between a first elevated position (illustrated in FIG. 2 by continuous lines) and a second retracted position (illustrated in FIG. 2 by dotted lines).

Referring now to FIGS. 1, 2 and 3, a supply of compressed air is coupled to air vibrator carriage assembly 82 by air hose 94 which is supported by boom 96. An additional length of air hose 98 is coupled between the upper end of boom 96 and trap 99 to permit rolling table 66 to be displaced between the first and second ends of bridge 14. Pressurized air is coupled from trap 99 through a pipe to surge chamber 100. A short pipe connects surge chamber 100 to air manifold 102. A one inch ball valve 104 is positioned between surge chamber 100 and air manifold 102 to couple and decouple the source of compressed air to the plurality of vibrator units.

A total of eight immersible vibrator units 106 are coupled to air manifold 102. Each air vibrator unit 106 includes a throttle valve 108 which controls the rate of flow of air into vibrator unit 106 and thereby controls the speed of vibration. The specific embodiment of the vibrator unit 106 used in the present invention is referred to as an internal spud vibrator. This device is manufactured by Koehring Company of Dayton, Ohio (model number A180) and includes an eccenstric weight in the lower portion thereof which is rotated by an air motor. This device has a rotational RPM range of seven to ten thousand five hundred revolutions per minute.

Figure 9:
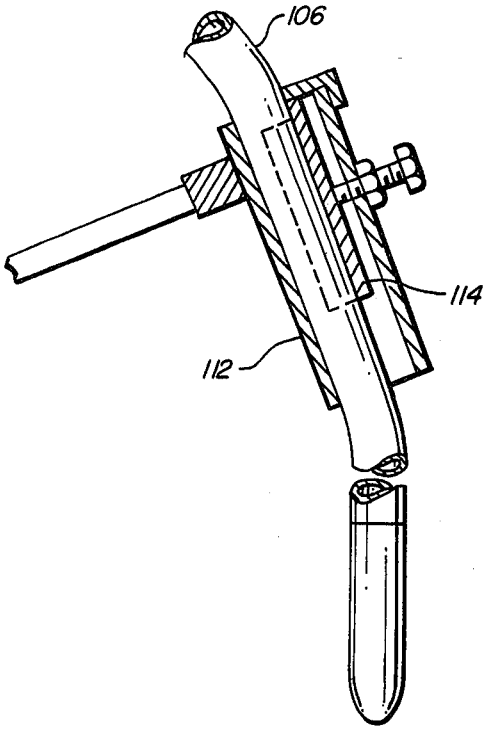
FIG. 9 is a sectional view of the air vibrator unit clamp illustrated in FIG. 8.
Figure 8:
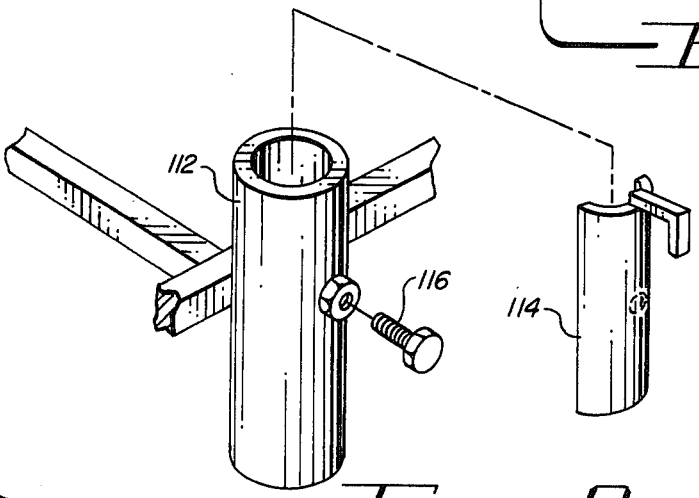
FIG. 8 is an exploded perspective view of the clamp which permits vertical adjustment of the air vibrator unit.

The upper portion of vibrator units 106 pass through and are supported by tubular support members 110. Air vibrator units 106 then pass through vertically oriented tubular support members 112. FIGS. 8 and 9 illustrate that the interior of each support member 112 includes a semi-cylindrical friction clamp member 114 which is held in place against the exterior side wall of vibrator unit 106 by bolt 116. This clamp assembly permits the vertical position of the vibrating tip of vibrator unit 106 to be readily adjusted. Clamp member 114 must not be pressed so tightly against the wall of vibrator unit 106 that the air flow is cut off.

It is highly desirable to provide vertical adjustment for the lower tip of vibrator unit 106 since it is generally desired that the vibrator tip come within two inches of the bottom deck form for the wet concrete. Since one of the primary purposes of the present invention is providing internal mechanical vibration to bridge decks and since bridge decks can include thicknesses of from between nine to twenty-five inches, the ability to provide substantial vertical adjustments of the position of the vibrating tip of air vibrator 106 is virtually essential. As the vertical vibrator tip spacing is adjusted the hump 118 in the air supply hose to air vibrator 106 will either decrease or increase in size as is appropriate.

Any one of a variety of commercially available air compressors can be used to provide a supply of compressed air to operate the present invention. The air compressor must supply not less than sixty PSI at surge chamber 100. The various pneumatically powered devices incorporated within the present invention require a flow of compressed air at the rate of two hundred and fifty cubic feet per minute. Because of the length of the various air lines which supply air to the various pneumatic elements of the present invention, it is recommended that an air compressor having a capacity of three hundred and fifty cubic feet per minute be utilized to compensate for line losses. Since only eight vibrator units 106 are required to provide mechanical internal vibration to areas of concrete having any given width, substantially increasing the width of bridge 14 will not increase the requirement for compressed air. As the width of bridge 14 expands, additional air vibrator units 62 will be required for the concrete strike off 60, but the compressed air requirements for these vibrators is very minimal.

Surge tank 48 is provided to serve as an accumulator tank to maintain the minimum desired pressure level at surge chamber 100 when valve 104 is opened to initially actuate the group of air vibrator units 106.

Following manufacture, a Vibrotach instrument or an equivalent RPM measuring device is coupled to each air vibrator unit 106. Each throttle valve 108 for each air vibrator unit 106 is adjusted so that each air vibrator 106 operates at a speed of 9000 RPM when the device is not immersed in concrete. Each of the air vibrators is adjusted so that all vibrators operate at nearly the same speed. When the air vibrators are immersed below the surface of the concrete, the operating speed will decrease under load.

In the preferred embodiment, the lateral spacing between each air vibrator unit 106 is equal to twelve inches. The fore and aft longitudinal displacement has also been selected to be twelve inches. A pair of bidirectional pneumatic control valves 120 are secured to surge chamber 100 and receive a supply of compressed air from surge chamber 100. One of these control valves controls the operation of pneumatic ram 84 and provides longitudinal displacement of the air vibrators between a first and second position. The other control valve controls the operation of pneumatic ram 92 and controls the vertical displacement of air vibrators 106.

At the job site the high density concrete placer of the present invention is first assembled and adjusted to fit the two parallel oriented side rails 10. Bridge 14 is positioned at the starting end of the area in which the wet concrete surface is to be densified. Rolling table 66 is positioned at one end of bridge 14 and ball valve 104 is actuated to commence operation of the air vibrators 106. A control valve 120 is actuated causing the air vibrator carriage assembly to be displaced downward permitting the vibrating tips of air vibrators 106 to penetrate below the surface of the wet concrete 12. After a predetermined time, this same control valve 120 is actuated causing the air vibrator carriage assembly to be elevated, removing the air vibrators from the concrete. At this point the second control valve 120 is actuated causing ram 84 to longitudinally displace the air vibrator carriage assembly into the second longitudinal position. Once again the air vibrator carriage assembly is lowered and then raised a predetermined period of time. At this point, the entire rolling table assembly is laterally shifted so that the next lateral section of concrete can be vibrated.

It has been found advantageous to position outermost air vibrators 122 as illustrated in FIG. 1 such that they have the capability of vibrating concrete at a position about six inches beyond the point at which rolling table 66 terminates its lateral translation with respect to bridge 14.

In the case discussed above where wet concrete is vibrated on twelve inch centers in two rows longitudinally displaced from one another by twelve inches, the bridge deck in longitudinally advance two feet following the completion of each lateral pass of rolling table 66. Since the high density concrete placer of the present invention is advanced only half as many times as prior art devices, a substantial amount of time is saved in comparison to prior art devices which do not provide a longitudinal shifting feature.

It will be apparent to those skilled in the art that the disclosed high density concrete placer may be modified in numerous ways and may assume many embodiments other than the preferred forms specifically set out and described above. For example, either more or fewer air vibrators can be incorporated onto air vibrator carriage assembly 82 as desired. It would also be possible to incorporate a longer pneumatic ram 84 which could provide three longitudinal vibration positions instead of the two disclosed above. Furthermore, it might be possible to incorporate two parallel bridges which support a single rolling table which could be laterally translatable along the length of the bridges and in addition could be longitudinally translatable between a number of positions over a substantial distance between the two bridges. Accordingly, it is intended by the appended claims to cover all such modification of the invention which fall within the true spirit and scope of the invention.

I claim:

1. A high density concrete placer longitudinally translatable along an area in which wet concrete has been poured, comprising:

a. a bridge having first and second ends;

b. first and second roller assemblies coupled to the first and second ends of said bridge for enabling said bridge to be longitudinally translated along said area;

c. a table including a plurality of immersible vibrator units coupled at spaced apart intervals along one side of said table and descending vertically downward therefrom for vibrating a segmented width of said wet concrete, wherein said segmented width is substantially narrower than the width of said wet concrete;

d. means coupled to said bridge and to said table for enabling said table to be incrementally laterally translated between the first and second ends of said bridge; and e. means coupled to said table for vertically displacing said vibrator units between a first and a second position wherein said vibrator units are positioned above the surface of the wet concrete in the first position and are immersed in the wet concrete in the second position; whereby said table may be laterally translated an incremental distance along said bridge when said vertical displacing means is in the first position; a segmental width of said concrete is vibrated when said vertical displacement means is in the second position; and the entire width of said wet concrete may be vibrated after at least one lateral translation of said table with respect to said bridge.

2. The high density concrete placer of claim 1 further including means coupled to said table for longitudinally displacing said vibrator units between a first and a second longitudinal position.

3. The high density concrete placer of claim 1 wherein said first and second roller assemblies include means for adjusting the elevation of the first and second ends of said bridge.

4. The high density concrete placer of claim 3 wherein said elevation adjusting means includes a first jack screw coupled between the first end of said bridge and said first roller assembly and a second jack screw coupled between the second end of said bridge and said second roller assembly.

5. The high density concrete placer of claim 1 further including means coupled to the first and second ends of said bridge and to said first and second roller assemblies for permitting said bridge to be skewed.

6. The high density concrete placer of claim 1 further including means for longitudinally translating said bridge.

7. The high density concrete placer of claim 6 wherein said bridge translating means includes:

a. a first winch coupled to the first end of said bridge and including a winch cable coupled to a stationary object positioned at a distance from said bridge; and b. a second winch coupled to the second end of said bridge and including a winch cable coupled to a stationary object positioned at a distance from said bridge.

8. The high density concrete placer of claim 7 wherein said first and second winches are manually operated.

9. The high density concrete placer of claim 1 wherein said bridge is fabricated in sections to permit multiple ones of said bridge sections to be joined together to form a bridge having a predetermined width.

10. The high density concrete placer of claim 1 wherein said bridge is fabricated from an open frame construction.

11. The high density concrete placer of claim 1 wherein said bridge further includes a walkway for permitting a worker to walk between the first and second ends of said bridge.

12. The high density placer of claim 1 wherein said immersible vibrator units are pneumatically powered.

13. The high density concrete placer of claim 12 wherein the lower portion of said immersible vibrator units include a cylindrical cross section.

14. The high density concrete placer of claim 12 wherein said immersible vibrator units are flexibly coupled to said frame.

15. The high density concrete placer of claim 12 wherein said plurality of immersible vibrator units are coupled to said frame at uniformly spaced apart intervals.

16. The high density concrete placer of claim 1 wherein said bridge includes front and rear sides and wherein the front side of said bridge is translated in a forward direction into the wet concrete.

17. The high density concrete placer of claim 16 wherein the lower front side of the said bridge includes a concrete strike off having a blade.

18. The high density concrete placer of claim 17 wherein said blade spans the entire width of the wet concrete.

19. The high density concrete placer of claim 17 wherein said screed includes means for vibrating said blade.

20. The high density concrete placer of claim 18 wherein said blade vibrating means includes a plurality of air vibrators coupled at spaced apart intervals to said blade.

21. The high density concrete placer of claim 1 wherein said means for laterally translating said frame includes a first roller assembly.

22. The high density concrete placer of claim 20 wherein said first roller assembly includes a plurality of rollers.

23. The high density concrete placer of claim 21 wherein said roller assembly includes guide rails for maintaining said frame in a fixed longitudinal position with respect to said bridge.

24. The high density concrete placer of claim 23 wherein said frame includes a subframe having a front end pivotally coupled to said table.

25. The high density concrete placer of claim 24 wherein said means for vertically displacing said vibrators includes a ram coupled to said table and to said subframe for elevating the rear end of said subframe to thereby displace said vibrator units between the first and second vertical positions.

26. The high density concrete placer of claim 24 wherein said ram is a pneumatic ram.

27. The high density concrete placer of claim 2 wherein said means for laterally translating said table includes a first roller assembly.

28. The high density concrete placer of claim 27 wherein said first roller assembly includes a plurality of rollers.

29. The high density concrete placer of claim 28 wherein said roller assembly includes guide rails for maintaining said table in a fixed longitudinal position with respect to said bridge.

30. The high density concrete placer of claim 29 wherein said table includes a subframe having a front end pivotally coupled to said table.

31. The high density concrete placer of claim 30 wherein said means for vertically displacing said vibrators includes a ram coupled to said table and to said subframe for elevating the rear end of said subframe to thereby displace said vibrator units between the first and second vertical positions.

32. The high density concrete placer of claim 31 wherein said means for longitudinally displacing said vibrator units includes a second roller assembly coupled between said table and said subframe.

33. The high density concrete placer of claim 32 wherein said means for longitudinally displacing said vibrator units includes a ram coupled to said table and to said subframe for longitudinally displacing said subframe with respect to said table.

34. The high density concrete placer of claim 33 wherein said ram includes a pneumatic ram.

35. The high density concrete placer of claim 34 further including a control valve assembly coupled to said table for controlling the flow of air to said pneumatic rams.

36. A high density concrete placer longitudinally translatable along a pair of parallel oriented support rails positioned adjacent to an area in which wet concrete has been poured comprising:

a. a bridge having first and second ends;

b. first and second roller assemblies coupled to the first and second ends of said bridge and contacting the support rails for supporting said bridge above the upper surface of the wet concrete and for enabling said bridge to be longitudinally translated along the support rails;

c. means coupled to the first and second ends of said bridge for controlling the elevation of said bridge with respect to the surface of wet concrete;

d. a table having front and rear sides and including:

i. a subframe having a front side pivotally coupled to the front side of said table;

ii. a plurality of immersible vibrator units coupled at spaced apart intervals to the rear side of said subframe and descending vertically downward therefrom for vibrating a segmental width of said wet concrete, wherein said segmental width is substantially less than the width of said concrete;

iii. means coupled to said table and to said subframe for vertically displacing the rear side of said subframe between a first and a second position wherein said vibrator units are elevated above the surface of the wet concrete in the first position and are immersed in the wet concrete in the second position; and e. means coupled to said bridge and to said table for enabling said table to be incrementally laterally translated between the first and second ends of said bridge; whereby said table may be laterally translated an incremental distance along said bridge when said vertical displacing means is in the first position; a segmental width of said concrete is vibrated when said vertical displacement means is in the second position; and the entire width of said wet concrete may be vibrated after at least one lateral translation of said table with respect to said bridge.

37. The high density concrete placer of claim 36 further including means coupled to said table and to said subframe for longitudinally displacing said vibrator units between a first and a second longitudinal position.

38. The high density concrete placer of claim 37 further including means for longitudinally translating said bridge along the support rails.

39. The high density concrete placer of claim 38 wherein said vibrator units are pneumatically powered and wherein said high density concrete placer includes means for supplying said vibrator units with compressed air.

40. The high density concrete placer of claim 38 wherein said means for longitudinally displacing said vibrator units includes a pneumatic ram and wherein said means for elevating the second end of said subframe includes a pneumatic ram.

41. The high density concrete placer of claim 40 wherein said compressed air supply means is coupled to said pneumatic rams.

42. A high density concrete placer longitudinally translatable along an area in which wet concrete has been poured comprising:

a. a bridge having first and second ends;

b. means for supporting said bridge above the surface of the wet concrete and for permitting said bridge to be longitudinally translated over the surface of the wet concrete;

c. means coupled to the first and second ends of said bridge for adjusting the elevation of the first and second ends of said bridge;

d. a table including a plurality of immersible vibrator units coupled at spaced apart intervals along one side of said table and descending vertically downward therefrom for vibrating a segmented width of said wet concrete, wherein said segmented width is substantially narrower than the width of said wet concrete;

e. means coupled to said bridge and to said table for enabling said table to be incrementally laterally translated between the first and second ends of said bridge;

f. means coupled to said table for vertically displacing said vibrator units between a first and a second position wherein said vibrating units are positioned above the surface of the wet concrete in the first position and are immersed in the wet concrete in the second position; and g. means coupled to said table for longitudinally displacing said vibrator units between a first and a second longitudinal position, whereby said vibrator units are longitudinally translated between the first and second positions by said longitudinal displacing means after being elevated into the first position by said vertical displacing means and the entire width of said wet concrete may be vibrated after at least one lateral translation of said table with respect to said bridge.

43. The high density concrete placer of claim 42 further including means coupled to the first and second ends of said bridge and to said bridge translating means for permitting said bridge to be skewed with respect to the support rails.

44. The high density placer of claim 42 wherein said bridge translating means includes:

a. a first winch coupled to the first end of said bridge and including a winch cable coupled to a stationary object positioned at a distance from said bridge; and b. a second winch coupled to the second end of said bridge and including a winch cable coupled to a stationary object positioned at a distance from said bridge.

45. The high density placer of claim 41 wherein said bridge further includes a walkway for permitting a worker to walk between the first and second ends of said bridge.

46. The high density placer of claim 42 wherein said plurality of immersible vibrator units are coupled to said frame at uniformly spaced apart intervals.

47. The high density concrete placer of claim 42 wherein said bridge includes front and rear sides and wherein the front side of said bridge is translated in a forward direction into the wet concrete.

48. The high density concrete placer of claim 46 wherein the lower front side of said bridge includes a concrete strike off having a blade.

49. The high density concrete placer of claim 47 wherein said strike off blade spans the entire width of wet concrete.

50. The high density concrete placer of claim 47 wherein said strike off includes means for vibrating said blade.

51. The high density concrete placer of claim 50 wherein said blade vibrating means includes a plurality of air vibrators coupled at spaced apart intervals to said blade.

52. A high density concrete placer longitudinally translatable along an area in which wet concrete has been poured comprising:

a. a bridge having first and second ends and a length greater than the width of wet concrete;

b. means for supporting said bridge above the surface of the wet concrete and for permitting said bridge to be longitudinally translated over the surface of the wet concrete;

c. a table having a width less than half the width of said bridge and including a plurality of immersible vibrator units coupled at spaced apart intervals along one side of said frame and descending vertically downward therefrom for vibrating a segmented width of said set concrete;

d. means coupled to said bridge and to said table for incrementally laterally translating said table between the first and second ends of said bridge; and e. means coupled to said table for vertically displacing said vibrator units between a first and a second position, wherein said vibrator units are positioned above the surface of the wet concrete in the first position and are immersed in the wet concrete in the second position; whereby said table may be laterally translated an incremental distance along said bridge when said vertical displacing means is in the first position; a segmental width of said concrete is vibrated when said vertical displacement means is in the second position; and the entire width of said wet concrete may be vibrated after at least one lateral translation of said table with respect to said bridge.

53. The high density concrete placer of claim 52 further including means coupled to said frame for longitudinally displacing said vibrator units between a first and a second longitudinal position.

* * * * *

UNITED STATES PATENT AND TRADEMARK OFFICE

CERTIFICATE OF CORRECTION

PATENT NO. : 4,314,773

DATED : February 9, 1982

INVENTOR(S) : J. Dewayne Allen

It is certified that error appears in the above-identified patent and that said Letters Patent are hereby corrected as shown below:

Title page, column 1, in the address of the inventor, please delete "Ariz." and substitute --Ark.--.

Signed and Sealed this

*Fourteenth* Day of *December 1982*

[SEAL]

*Attest:*

GERALD J. MOSSINGHOFF

*Attesting Officer*

*Commissioner of Patents and Trademarks*